US006706329B1

(12) United States Patent
Chien

(10) Patent No.: US 6,706,329 B1
(45) Date of Patent: Mar. 16, 2004

(54) LOCAL NICKEL PLATING FOR ALUMINUM ALLOY RADIATOR

(76) Inventor: Ming-Ho Chien, No. 3, Min Chaun St., Shulin City, Taipei Hsien (TW)

( * ) Notice: Subject to any disclaimer, the term of this patent is extended or adjusted under 35 U.S.C. 154(b) by 0 days.

(21) Appl. No.: 10/300,787

(22) Filed: Nov. 21, 2002

(51) Int. Cl.[7] ..... B05D 1/36; B05D 1/18; B05D 3/12; B05D 3/10

(52) U.S. Cl. ..... 427/406; 427/327; 427/346; 427/436; 427/437; 427/438; 427/405; 427/600

(58) Field of Search ..... 427/327, 346, 427/435, 436, 437, 438, 405, 406, 600

(56) References Cited

U.S. PATENT DOCUMENTS 4,346,128 A * 8/1982 Loch ..... 427/328

5,448,107 A * 9/1995 Osada et al. ..... 257/706

* cited by examiner

*Primary Examiner*—Michael Barr

(74) *Attorney, Agent, or Firm*—Browdy and Neimark, P.L.L.C.

(57) ABSTRACT

A method for locally nickel-plating an aluminum alloy fin structure including placing the aluminum alloy fin structure on a sponge that is located at the bottom of a "zinc" tank containing a volume of zinc chemical solution for zinc plating; and thereafter rotating the aluminum alloy fin structure and immersing the rotated aluminum alloy fin structure in a volume of nickel chemical solution of a "nickel" tank to plate nickel onto the aluminum alloy fin structure.

9 Claims, 10 Drawing Sheets

LOCAL NICKEL PLATING FOR ALUMINUM ALLOY RADIATOR

BACKGROUND OF THE INVENTION

1. Field of the Invention

The present invention relates generally to a local Ni plating method for aluminum alloy radiators, which is suited for Ni plating terminals of an aluminum alloy radiator structure, i.e., the connecting ends of the aluminum alloy radiator to connect a copper base. According to the claimed invention, the new Ni plating method improves the uniformity of nickel-plating layer plated on the terminals of the radiator. The appearance of the radiator is meliorated and the heat-dissipating performance of the aluminum alloy radiator is significantly enhanced. Further, excess zinc residuals left on the aluminum alloy radiator can be recovered from the Ni plating process.

2. Description of the Prior Art

A prior art aluminum-copper combined radiator typically consisting of a copper base and an aluminum alloy fin structure mounted on the copper base is known in the art. To tightly joint the aluminum alloy fin structure and the copper base together, a lay of nickel is plated onto the connecting ends of the aluminum alloy fin structure, a solder paste is then coated on the nickel layer. FIG. 1 illustrates a process flow of a prior art method of locally nickel-plating an aluminum alloy radiator 1*a*. FIG. 2 and FIG. 3 are schematic diagrams illustrating the prior art nickel-plating process for the aluminum alloy radiator. As shown in FIG. 1 to FIG. 3, before implementing the nickel plating process, the lower end of the aluminum alloy fin structure 1*a* is dipped in a "Zn" tank 2*a* containing a volume of zinc solution 21*a* for partially zinc plating. Since the aluminum alloy fin structure 1*a* includes a plurality of aluminum alloy fins 11*a* each of which is arranged in parallel with adjacent fins with a very small interval, the dipping depth of the lower end of the aluminum alloy fin structure 1*a* under the liquid surface of the zinc solution 21*a* cannot be finely controlled; thus resulting in a zinc layer plated on the lower end of the aluminum alloy fins 11*a* having an elevation profile, as shown in FIG. 4. The entire aluminum alloy fin structure 1*a* is then dipped into a volume of nickel solution 31*a* in a "Ni" tank 3*a* for nickel plating. During the nickel plating process, only the zinc layer 12*a* is plated with nickel, resulting in an unpleasant black nickel layer having same elevation profile. Since the nature of inferior thermal conductivity property of nickel, the heat-dissipating performance of the aluminum alloy fin structure 1*a* is thus reduced. Moreover, during the nickel plating process, excess zinc residuals will remain at the intervals between the parallel aluminum alloy fins 11*a*, as shown in FIG. 5.

SUMMARY OF THE INVENTION

Accordingly, the primary objective of the invention is to provide an improved nickel-plating method for locally plating an aluminum alloy fins of a radiator, thereby improving thermal performance and appearance.

Another objective of the present invention is to provide a local nickel-plating method for aluminum alloy radiators. During the nickel-plating process, excess zinc residuals remained on the radiator can be recovered and reused. The consumption of nickel plated on the aluminum alloy fins may be reduced down to about one tenth of original amount.

According to the claimed invention, an improved method for locally nickel-plating an aluminum alloy fin structure is provided. The method of this invention includes: placing the aluminum alloy fin structure on a sponge that is located at the bottom of a "zinc" tank containing a volume of zinc chemical solution for zinc plating; and thereafter rotating the aluminum alloy fin structure and immersing the rotated aluminum alloy fin structure in a volume of nickel chemical solution of a "nickel" tank to plate nickel onto the aluminum alloy fin structure.

Other objects, advantages and novel features of the invention will become more clearly and readily apparent from the following detailed description when taken in conjunction with the accompanying drawings.

DETAILED DESCRIPTION OF THE PREFERRED EMBODIMENT

Figure 1:
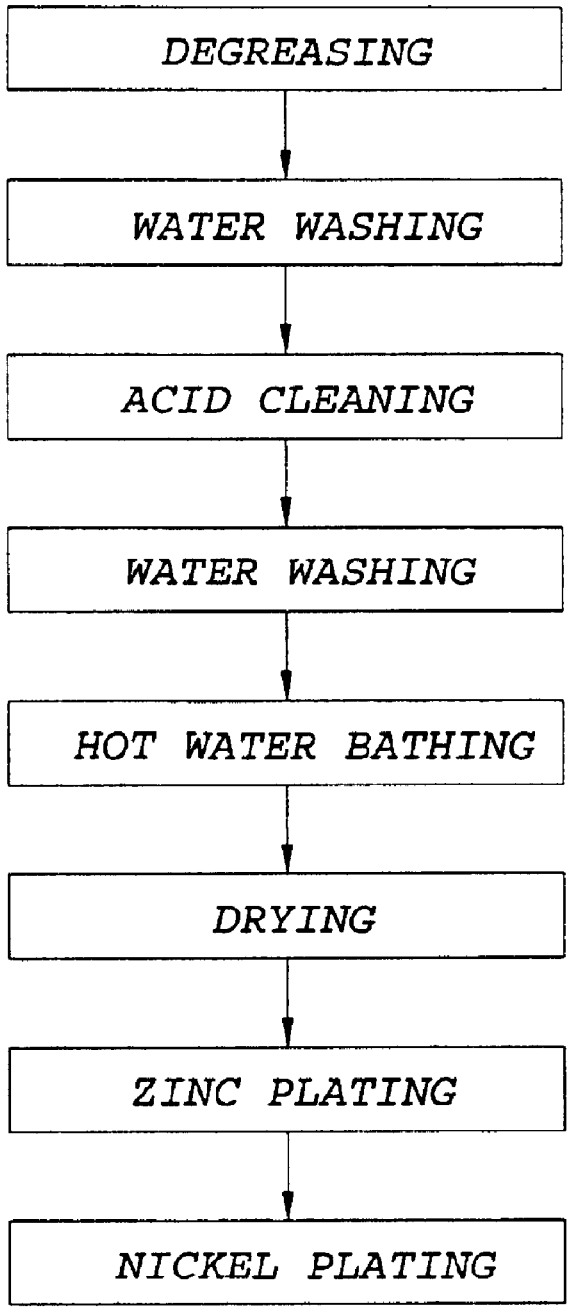
FIG. 1 PRIOR ART
FIG. 1 is a flow diagram illustrating a conventional nickel-plating method for an aluminum alloy fin structure.
Figure 2:
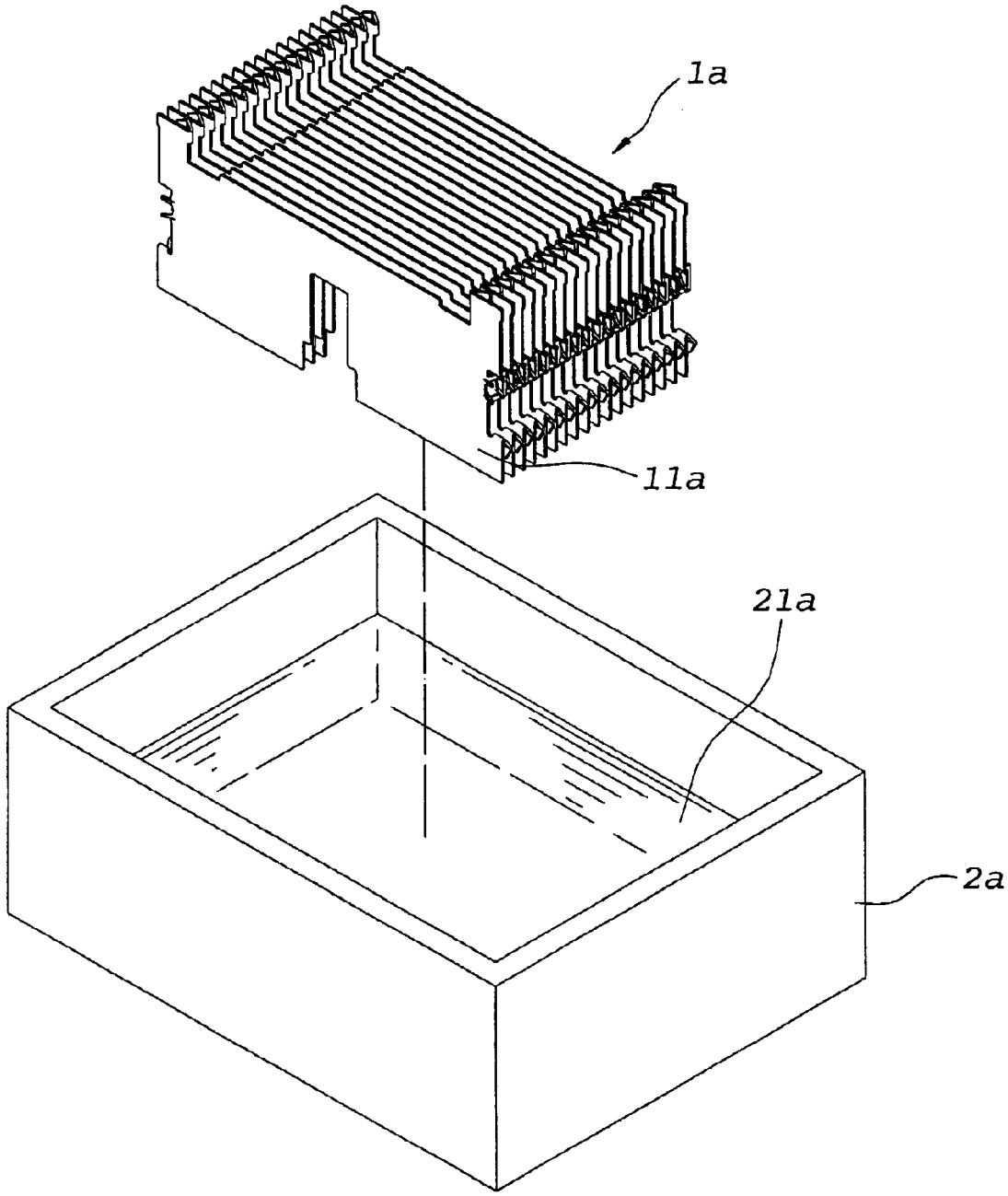
FIG.2 PRIOR ART
FIG. 2 is a typical view showing prior art zinc-plating method.
Figure 3:
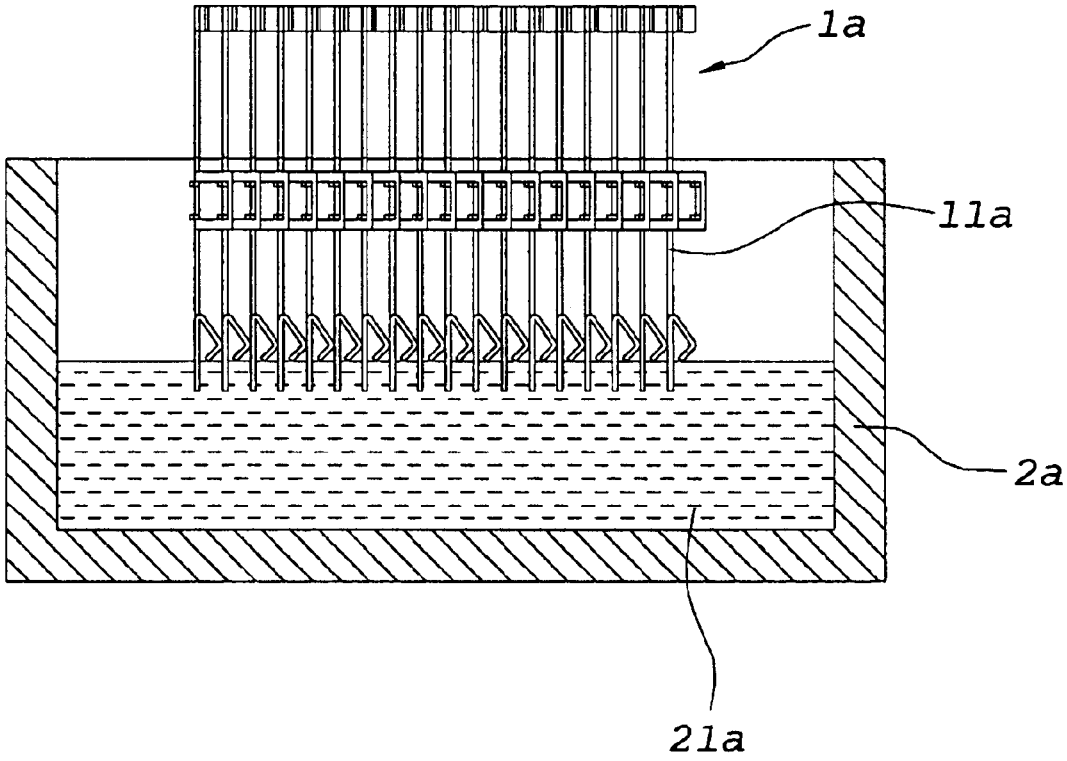
FIG. 3 PRIOR ART
FIG. 3 is a cross-sectional view showing the aluminum alloy fin structure after zinc-plating according to the prior art.
Figure 4:
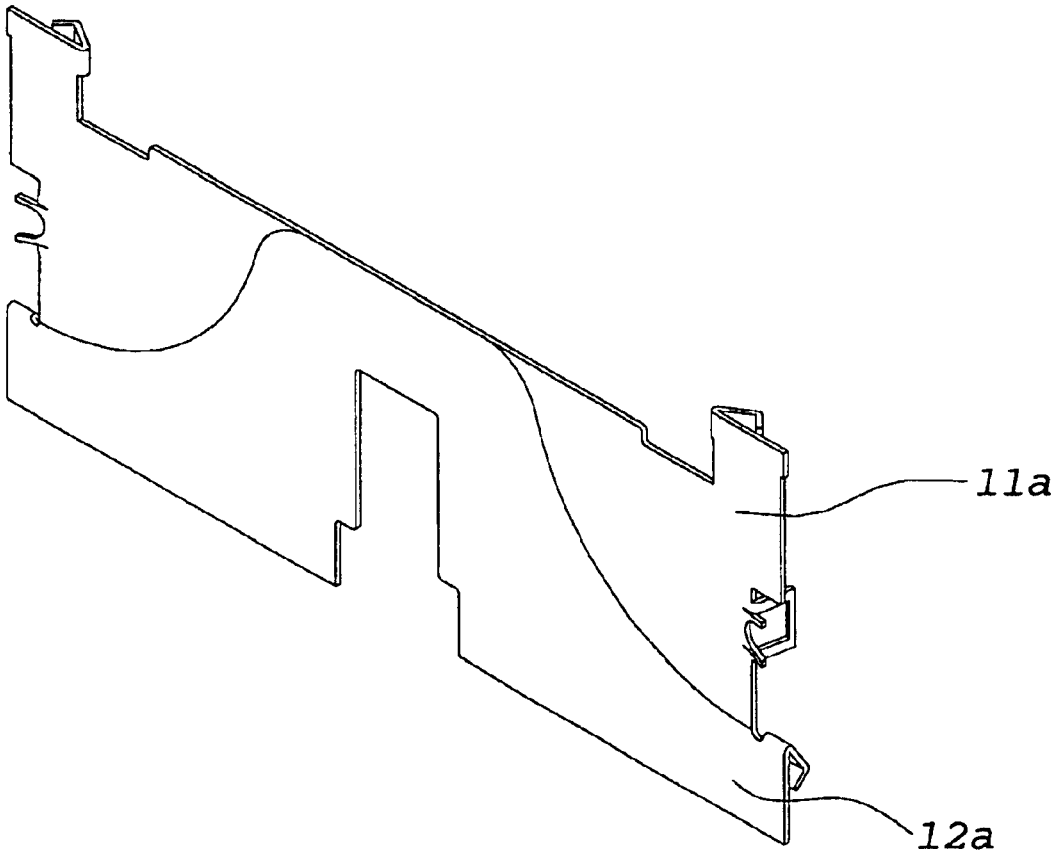
FIG. 4 PRIOR ART
FIG. 4 is a perspective view of a single fin after zinc-plating according to the prior art.
Figure 5:
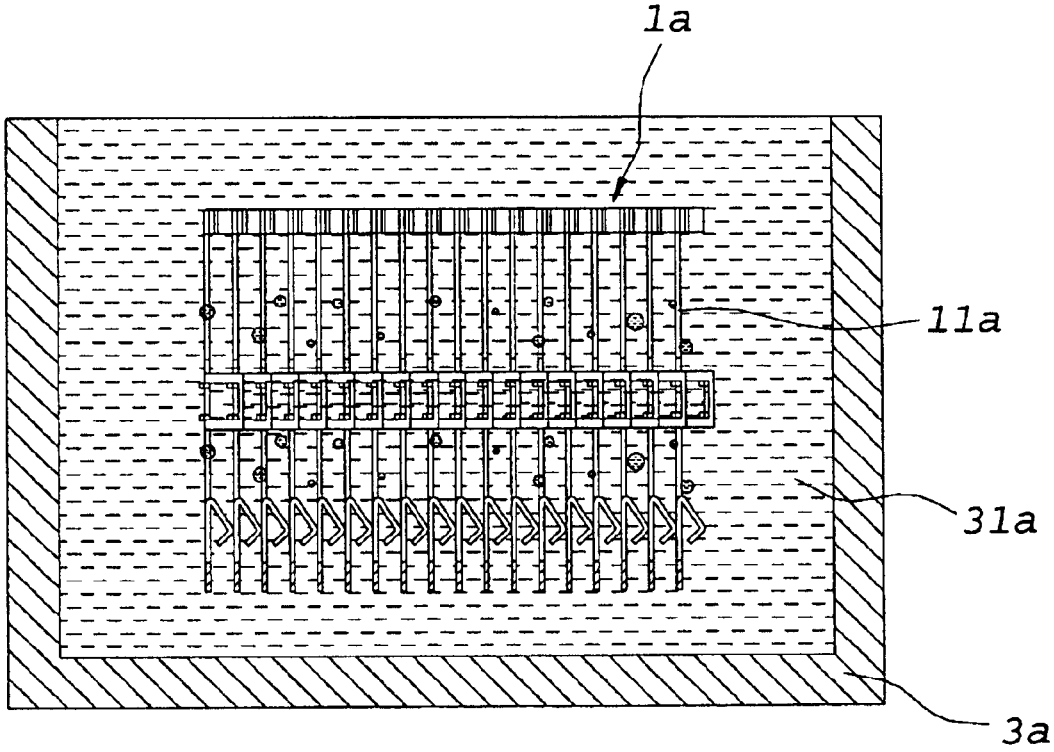
FIG. 5 PRIOR ART
FIG. 5 is a cross-sectional view showing the aluminum alloy fin structure during a nickel-plating process according to the prior art.
Figure 6:
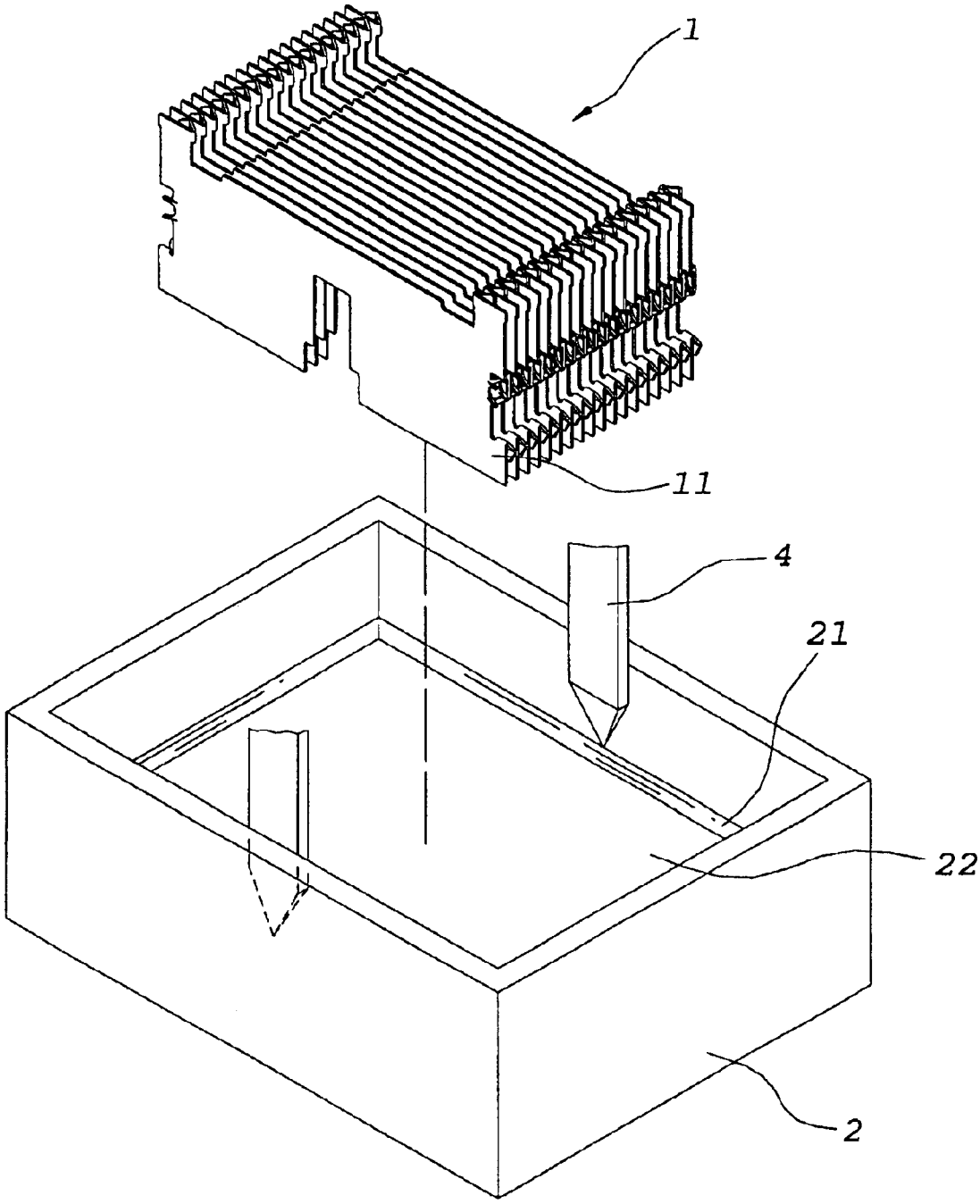
FIG. 6 is a perspective view schematically showing the aluminum alloy fin structure and associated components when implementing a zinc plating process according to the present invention.
Figure 7A:
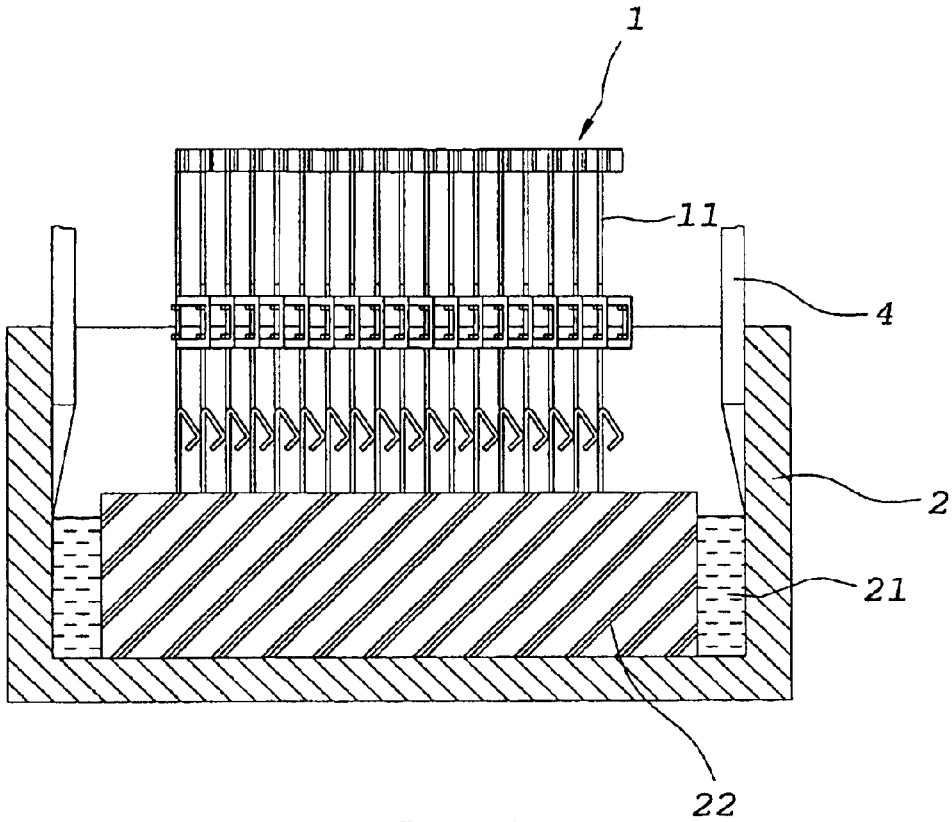
FIG. 7A to FIG. 7C are cross-sectional diagrams illustrating the zinc plating process according to the present invention.
Figure 7B:
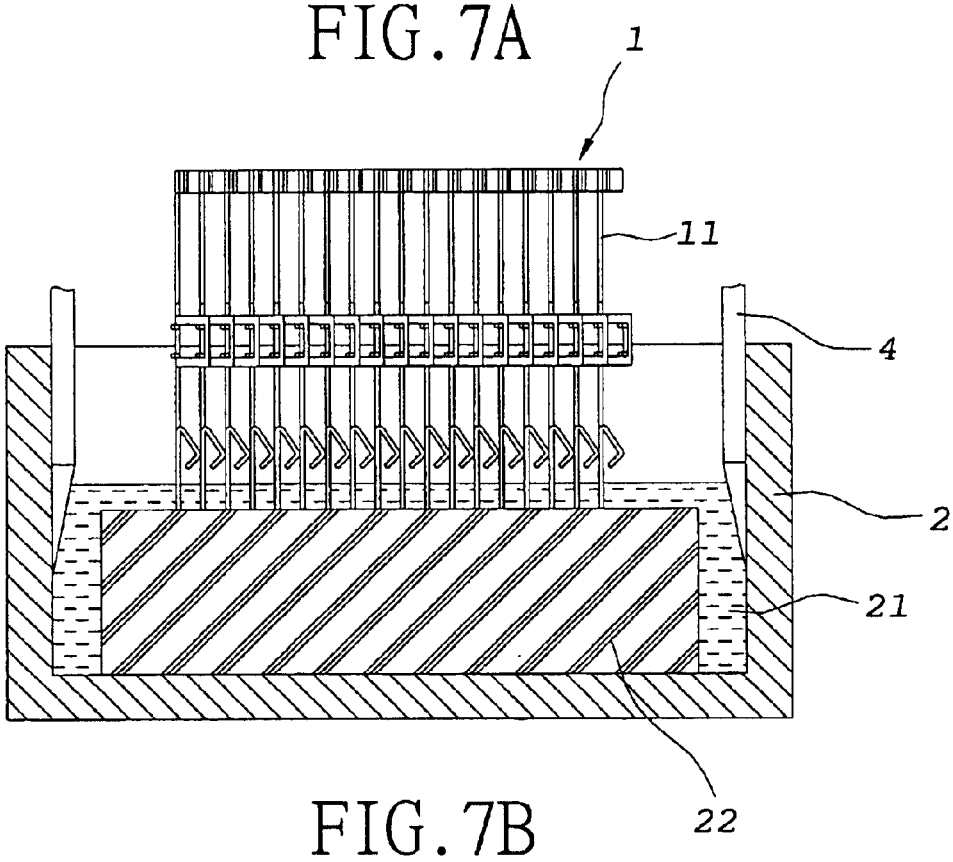
Figure 7C:
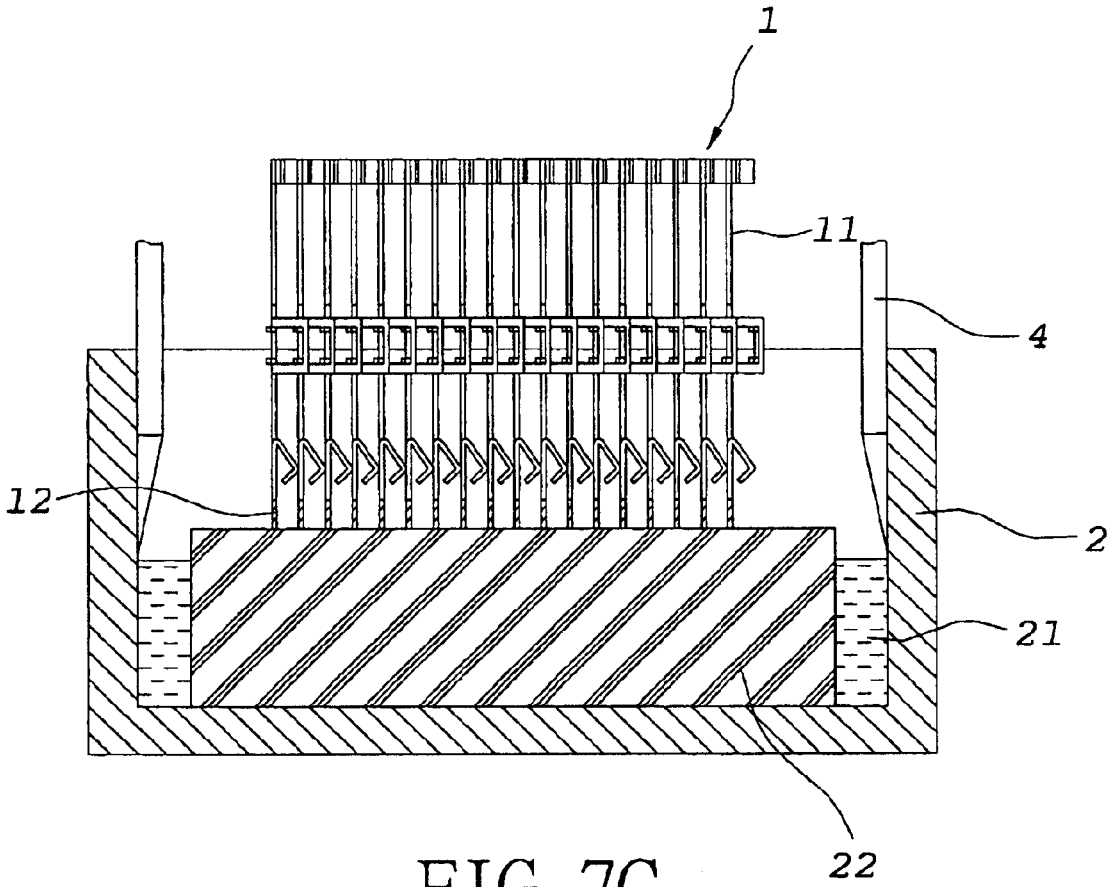
Figure 8:
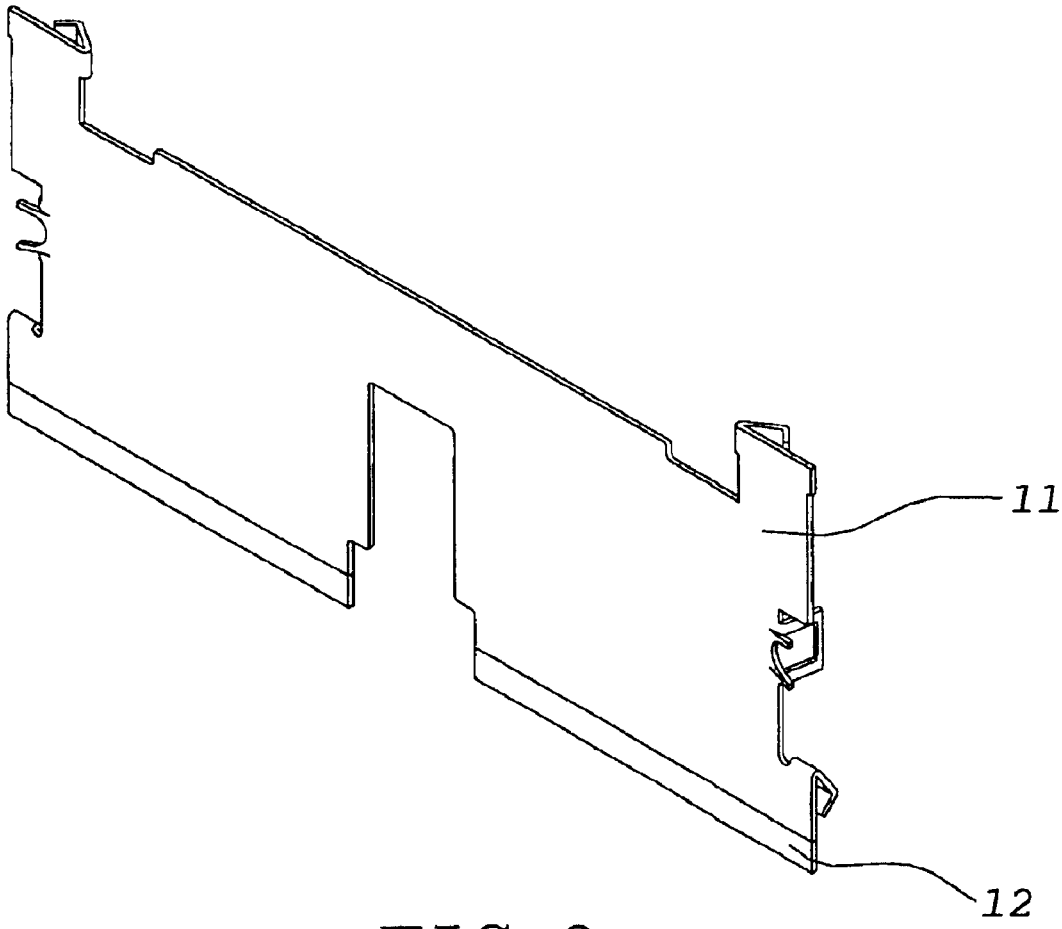
FIG. 8 is a perspective view showing the uniform zinc plating layer on a single fin according to the present invention.
Figure 9:
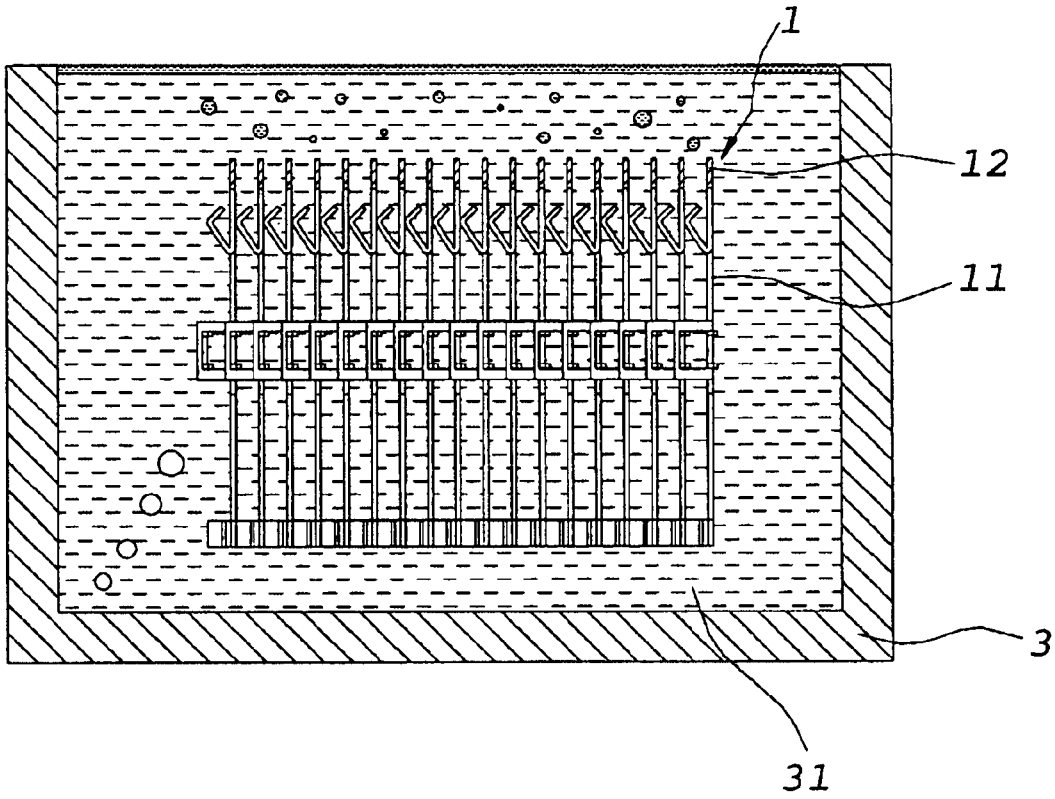
FIG. 9 is a cross-sectional view showing the aluminum alloy fin structure during a nickel-plating process according to the present invention.

This invention relates to a local nickel-plating method, comprising the following steps:

a. Pre-treating an aluminum alloy fin structure with a sequence of steps comprising degreasing, water washing, acid clean, water washing, hot water bathing, and then drying. After the surface treatment, the surface of the aluminum alloy fin structure is ready for further process, that is, zinc plating.

b. Placing the aluminum alloy fin structure on a sponge 22 that is located at the bottom of a "zinc" tank 2 containing a volume of zinc chemical solution 21. At this phase, the liquid level of the zinc chemical solution 21 is lower than the elevation of the sponge 22 (as shown in FIG. 6 and FIG. 7A).

c. During the zinc plating, two spiked pieces 4 are inserted into the zinc chemical solution 21 of the "zinc" tank 2 to make the liquid level of the zinc chemical solution 21 higher than the height of the sponge 22 by 0 to 5 mm. Then, the dipped portion of the aluminum alloy fin structure 1 on the sponge 22 starts to zinc plating (as shown in FIG. 7B). Thereafter, the two spiked pieces 4 are removed from the zinc chemical solution 21 of the "zinc" tank 2 (as shown in FIG. 7C), thereby forming a uniform strip of zinc layer on the aluminum alloy fins 11 (as shown in FIG. 8). Optionally, the aluminum alloy fin structure 1 is treated by water washing and ultrasonication.

d. The aluminum alloy fin structure 1 is rotated and then immersed in a volume of nickel chemical solution in a "nickel" tank 3 (as shown in FIG. 9). Since the nickel will be plated only on the zinc layer 12 previously coated on the fins 11, a uniform strip of nickel layer which has smaller plating area than that of prior art is formed, thereby improving the thermal transfer performance and appearance of the aluminum alloy fins. An air supply is provided at the bottom of the "nickel" tank 3 for bubbling air into the nickel chemical solution during the plating. Bubbles will bring excess zinc residuals on the aluminum alloy fin structure 1 up to surface of the nickel chemical solution 31. By doing this, no zinc residuals will be observed in the intervals between adjacent fins 11.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for locally nickel-plating an aluminum alloy fin structure, comprising:

placing the aluminum alloy fin structure on a sponge that is located at the bottom of a "zinc" tank containing a volume of zinc chemical solution for zinc plating; and thereafter rotating the aluminum alloy fin structure and immersing the rotated aluminum alloy fin structure in a volume of nickel chemical solution of a "nickel" tank to plate nickel onto the aluminum alloy fin structure.

2. The method for locally nickel-plating an aluminum alloy fin structure as claimed in claim 1 wherein during the zinc plating, the liquid level of the zinc chemical solution is higher than the height of the sponge by 0 to 5 mm.

3. The method for locally nickel-plating an aluminum alloy fin structure as claimed in claim 1 further comprising inserting two spiked pieces into the zinc chemical solution.

4. The method for locally nickel-plating an aluminum alloy fin structure as claimed in claim 1 wherein an air supply is provided at the bottom of the "nickel" tank for bubbling air into the nickel chemical solution.

5. The method for locally nickel-plating an aluminum alloy fin structure as claimed in claim 4 wherein the air supply creates a plurality of bubbles to bring excess zinc residuals on the aluminum alloy fin structure up to surface of the nickel chemical solution.

6. The method for locally nickel-plating an aluminum alloy fin structure as claimed in claim 1 wherein before rotating the aluminum alloy fin structure, the method further comprises a step of water washing and a step of ultrasonication.

7. The method for locally nickel-plating an aluminum alloy fin structure as claimed in claim 1 wherein before the zinc plating, the method further comprises a step of degreasing.

8. The method for locally nickel-plating an aluminum alloy fin structure as claimed in claim 1 wherein before the zinc plating, the method further comprises a step of acid cleaning.

9. The method for locally nickel-plating an aluminum alloy fin structure as claimed in claim 1 wherein before the zinc plating, the method further comprises a step of hot water bathing and a step of drying.

* * * * *